US006837198B2

(12) United States Patent
Maas et al.

(10) Patent No.: US 6,837,198 B2
(45) Date of Patent: Jan. 4, 2005

(54) VARIABLE VALVE DISTRIBUTOR FOR LOAD-CONTROLLING A SPARK-IGNITED INTERNAL COMBUSTION ENGINE

(75) Inventors: Gerhard Maas, Seukendorf (DE); Frank Himsel, Neuhaus (DE)

(73) Assignee: INA-Schaeffler KG (DE)

( * ) Notice: Subject to any disclaimer, the term of this patent is extended or adjusted under 35 U.S.C. 154(b) by 0 days.

(21) Appl. No.: 10/415,845

(22) PCT Filed: Sep. 20, 2001

(86) PCT No.: PCT/EP01/10863

§ 371 (c)(1),
(2), (4) Date: May 30, 2003

(87) PCT Pub. No.: WO02/35067

PCT Pub. Date: May 2, 2002

(65) Prior Publication Data

US 2004/0074457 A1 Apr. 22, 2004

(30) Foreign Application Priority Data

Oct. 25, 2000 (DE) ..... 100 52 811

(51) Int. Cl.[7] ..... F01L 1/34

(52) U.S. Cl. ..... 123/90.16; 123/90.15; 74/53; 74/54; 74/569

(58) Field of Search ..... 123/90.15, 90.16, 123/90.17, 90.18, 90.39, 90.6; 74/53, 54, 55, 25, 567, 569

(56) References Cited

U.S. PATENT DOCUMENTS

| | | | | |
|---|---|---|---|---|
| 4,084,557 A | * | 4/1978 | Luria | 123/90.15 |
| 4,572,118 A | | 2/1986 | Baguena | |
| 4,714,057 A | * | 12/1987 | Wichart | 123/90.15 |
| 4,917,058 A | | 4/1990 | Nelson et al. | |
| 5,373,818 A | | 12/1994 | Unger | |
| 5,452,694 A | | 9/1995 | Hara | |
| 5,680,835 A | | 10/1997 | Ruffing et al. | |
| 5,954,018 A | * | 9/1999 | Joshi | 123/90.16 |

FOREIGN PATENT DOCUMENTS

| | | |
|---|---|---|
| DE | 4226789 | 2/1994 |
| DE | 19640520 | 4/1998 |
| EP | 0596860 | 5/1994 |
| EP | 0962629 | 12/1999 |
| WO | 9936677 | 7/1999 |

* cited by examiner

*Primary Examiner*—Thomas Denion
*Assistant Examiner*—Jaime Corrigan
(74) *Attorney, Agent, or Firm*—Muserlian, Lucas and Mercanti

(57) ABSTRACT

The invention proposes a variable valve train (1) for throttle-free load control of an internal combustion engine. Each cylinder of the internal combustion engine is provided with two inlet valves (9). According to the invention, each inlet valve (9) cooperates with a particular adjusting element (8, 8*a*), and the adjusting elements (8, 8*a*) can be actuated independently of each another. This additionally enhances the variability of the valve train.

8 Claims, 1 Drawing Sheet

VARIABLE VALVE DISTRIBUTOR FOR LOAD-CONTROLLING A SPARK-IGNITED INTERNAL COMBUSTION ENGINE

This application is a 371 of PCT/EP00/10863 filed Sep. 20, 2001.

FIELD OF THE INVENTION

The invention concerns a variable valve train for load control of a spark-ignited internal combustion engine, said valve train being arranged between cams of a camshaft and inlet valves of cylinders of the internal combustion engine and comprising direct valve actuating elements, transmission elements and adjusting elements for influencing the lifting function of the transmission elements that are drivingly installed between the cams and the valve actuating elements and have first working surfaces loaded by the cams and second working surfaces acting on the valve actuating elements.

BACKGROUND OF THE INVENTION

The advantages of throttle-free load control through variable or fully variable valve trains are sufficiently well known in the technical field. By dispensing with throttles, it is possible to eliminate the suction losses that otherwise occur over a wide range of load conditions of the internal combustion engine.

A valve train of the pre-cited type is disclosed in DE 195 09 604 A1. However, a person skilled in the art finds no information in this publication as to how two identically operating inlet valves of a single cylinder can be adjusted independently of each other. Thus, drawbacks are to be expected in the mixture preparation because, for example, low loads and low rotational speeds result in a too feeble turbulence of the charge. In the described state of the internal combustion engine, the too feeble turbulence can lead to a precipitation of fuel upon expansion of the cylinder charge when the inlet valve has closed. On the other hand, a large gas exchange cross-section would be desirable at high speeds of rotation and high loads because it creates a tumble stream that favors high performance. Thus, seen as a whole, the generic valve train does not possess sufficient variability.

OBJECT OF THE INVENTION

The object of the invention is therefore to provide a valve train of the pre-cited type that is distinctly more variable and, at the same time, relatively simple to operate.

SUMMARY OF THE INVENTION

The invention achieves the above object in that each cylinder possesses at two inlet valves (9), and at least one particular part of the transmission element comprising the second working surface (13) and one particular element (8,8*a*) are associated to each inlet valve (9), said particular adjusting element (8,8*a*) being displaceable relative to a further adjusting element (8,8*a*) of a second inlet valve (9) or to further adjusting elements of further inlet valves of each cylinder.

Accordingly, each cylinder possesses at least two inlet valves, and at least one particular part of the transmission element comprising the second working surface and one particular adjusting element are associated to each inlet valve, said particular adjusting element being displaceable relative to a further adjusting element or to further adjusting elements of further inlet valves of each cylinder.

With these measures, the initially described drawbacks are eliminated. All the inlet valves (advantageously two) of each cylinder can be adjusted independently of one another. Thus, it is possible, for example, that during idle running, one gas exchange valve is completely shut off and the other executes only a low lift. In this way, the turbulence of the charge can be infinitely influenced so that the aforesaid drawbacks are effectively eliminated. The variability of the entire valve train becomes very similar to that of an electromagnetic valve timing control with which each gas exchange valve can be regulated individually.

According to a first embodiment of the invention, the adjusting elements that are configured, for instance, as pivoting fingers or eccentrics extend on telescopically inter-inserted shafts (hollow shaft and further shaft). The hollow shaft is rigidly connected to the adjusting elements of a first row of identical inlet valves of all the cylinders and the further shaft is rigidly connected to the adjusting elements of a further row of adjacent, identical inlet valves of all the cylinders, the shafts, together with the adjusting elements being rotatable relative to each other. In this way, it is no longer necessary to actuate the different adjusting elements of each cylinder separately.

A further conceivable solution that is explicitly included in the scope of the invention concerns an embodiment in which it is not the inlet valves of each cylinder that are controlled independently of one another but the inlet valves of at least two cylinders that can be actuated differently from each other. This means that all the adjusting elements of one particular cylinder are connected to the hollow shaft and all the adjusting elements, for instance, of an adjacent cylinder are connected through entraining elements to the further shaft that extends within the hollow shaft. This configuration thus makes it possible to shut off a cylinder. Thus, one cylinder can be deactivated while a valve lift takes place at another cylinder.

The adjusting elements may also be configured as eccentrics and applied in accordance with the solution of the aforesaid document DE 195 09 604 A1. However, it is also possible to configure the adjusting elements as pivoting fingers as illustrated in the appended drawing.

Segment-shaped slots in the hollow shaft for the entraining elements of the adjusting elements of the further row of identical inlet valves at the same time define a maximum angle of relative rotation of the adjusting elements.

According to a further sub-claim, the adjusting elements of the hollow shaft are fixed thereon in a simple manner by an interference fit. The further adjusting elements are fixed on the further shaft, for instance, by an entraining element configured as a pin. Here, too, it is possible to use an interference fit or a screw connection and the like.

According to a further advantageous feature of the invention, the hollow shaft and the further shaft can be actuated separately. For this purpose, an electric or hydraulic actuator is arranged on a front end of each shaft. However, it is also possible to provide inter-inserted actuators only on one end of the shafts.

In a preferred embodiment of the invention according to a further sub-claim, the separate adjusting elements are arranged on a ratchet-type valve train whose transmission elements are made up of two parts. The adjusting elements are configured as pivoting fingers comprising a scanning contour that is scanned during cam lift by a part of the transmission element configured as a ratchet.

Finally, it is proposed to use a finger lever as a valve actuating element. However, it is both conceivable and within the scope of the invention to use oscillating levers or rocker arms, and also cup tappets.

It is expressly stated that the scope of the intention does not extend only to a valve train as described in accordance with the appended drawing but also to valve trains comprising an adjusting means as disclosed, for example, in the aforesaid generic document DE 195 09 604 A1.

BRIEF DESCRIPTION OF THE DRAWING

The invention will now be described more closely with reference to the appended drawing.

DETAILED DESCRIPTION OF THE DRAWING

Figure 1:
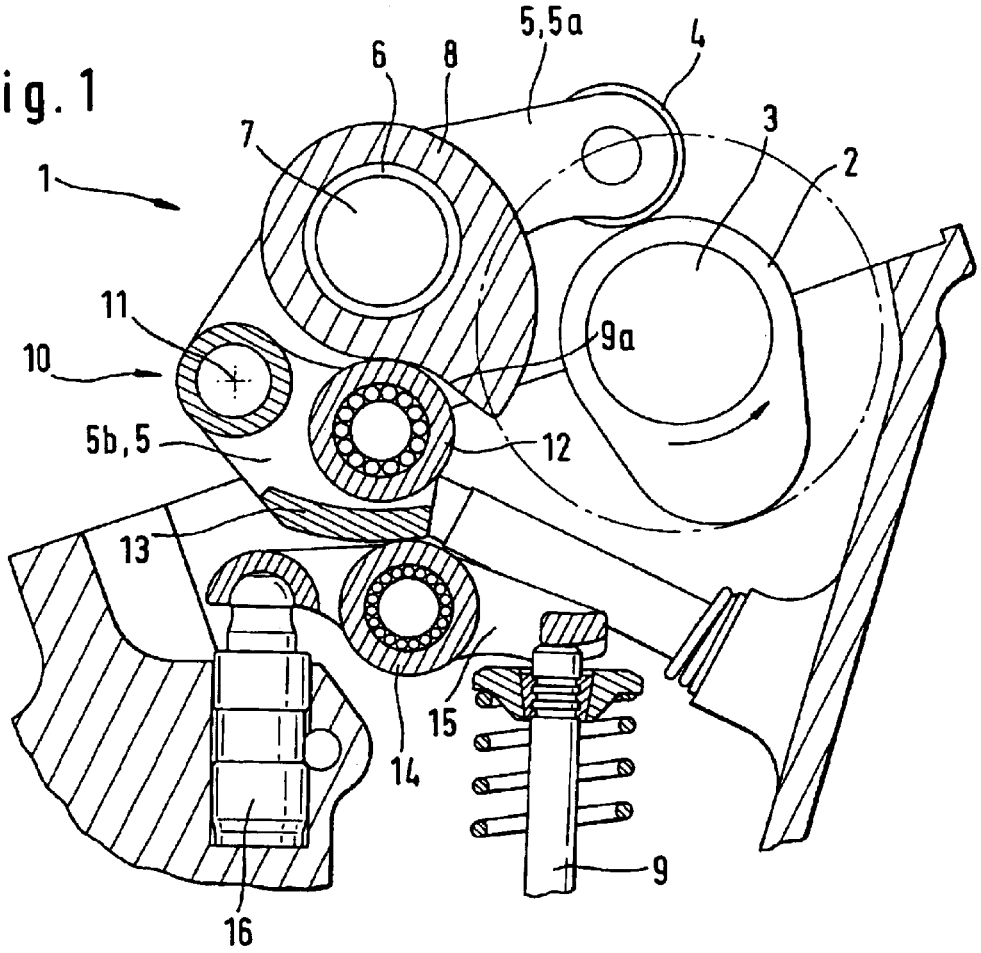
FIG. 1 is a schematic view of a variable valve train.
Figure 2:
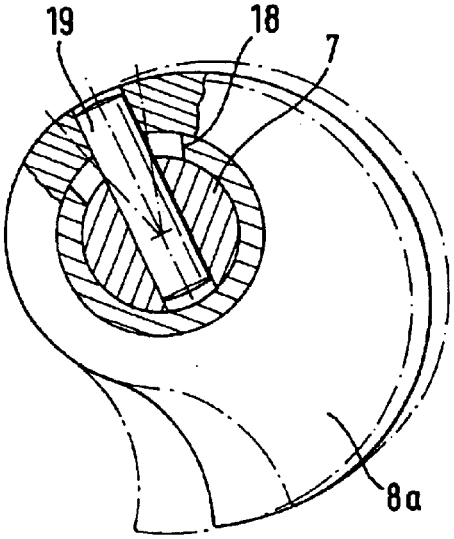
FIG. 2 shows an adjusting element configured as pivoting finger, for the valve train of FIG. 1.

FIG. 1 discloses a variable valve train 1, the basic principle and mode of functioning of which are known in the technical field. The valve train 1 serves for load control of a spark-ignited internal combustion engine and is fully variable. This figure shows a cam 2 of a camshaft 3 that acts on a first working surface 4 (roller) of a two-part transmission element 5 that is configured on its cam-proximate side as a lever 5*a*. This lever 5*a* is mounted approximately centrally on a hollow shaft 6 (see also FIG. 3). The hollow shaft 6 surrounds a further shaft 7 for relative rotation thereto. An adjusting element 8 is disposed on a long side of the lever 5*a*. This adjusting element 8 serves to influence the lift of a first row of identical inlet valves 9 of the cylinders. The adjusting element 8 is fixed on the hollow shaft 6 by a press fit and comprises a scanning contour 9*a* situated opposite the ratchet 5*b*.

The ratchet 5*b* is fixed on a fulcrum 11 situated on an end 10 opposite from the first working surface 4 of the lever 5*a*. The ratchet 5*b* can pivot relative to the fulcrum 11 and comprises a third working surface 12 which is configured as a roller and cooperates with the scanning contour 9*a*. The ratchet 5*b* further comprises a second working surface 13 oriented away from the third working surface 12. The second working surface 13 acts on a contact surface 14 (roller) of a direct valve actuating element 15. This direct valve actuating element 15 is configured in the present example of embodiment as a finger lever that is mounted at one end on a support element 16 and acts at the other end in lifting direction on the inlet valve 9.

When a cam lift causes the lever 5*a* to pivot together with the ratchet 5*b*, this latter is forced to move in a channel situated between the scanning contour 9*a* and the contact surface 14. In the angular position of the adjusting element 8 shown in FIG. 1, this produces a maximum lift on the inlet valve 9. The movement imparted to the ratchet 5*b* is therefore composed of a movement of rotation about the fulcrum 11 and a movement of translation in the aforesaid channel.

For obtaining a desired zero lift of the inlet valve 9, for instance, the adjusting element 8 is rotated in anti-clockwise direction by a rotation of the hollow shaft 6 effected by an actuator, not specified, that is arranged on an end of the hollow shaft 6. This anti-clockwise rotation of the adjusting element 8 is continued till the third working surface 12 of the ratchet 5*b* traverses only a fore-positioned base circle segment of the scanning contour 9*a*. Thus, the ratchet 5*b* does not pivot in opening direction of the inlet valve 9 and this remains closed.

FIGS. 2, 3:

However, the valve train is to be designed for at least two inlet valves for each cylinder. Each inlet valve 9 then has its own transmission element 5 at least in the region of the ratchet 5*b*. Each ratchet 5*b* is associated to a separate adjusting element 8, 8*a* so that the two inlet valves 9 of each cylinder can be adjusted independently of each other (see also discussion of advantages in connection with the claims).

For this purpose, as mentioned above, the hollow shaft 6 houses a relatively rotatable further shaft 7 in its bore 17. The hollow shaft 6 and the further shaft 7 can be actuated by actuators operating independently of each other. It is conceivable to arrange one actuator at one end of the shafts 6, 7 and a further actuator at the other end of the shafts 7, 6. It is conceivable, for instance, to use hydraulic, electric or electro-hydraulic and similar measures.

Figure 3:
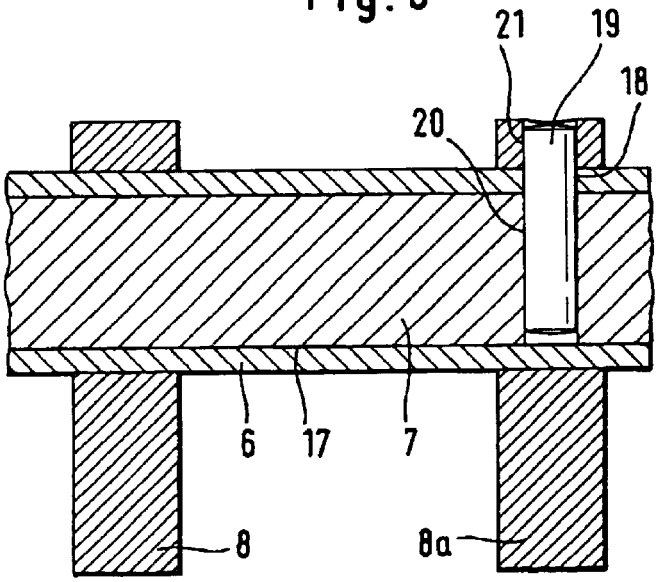
FIG. 3 is a longitudinal section through the shafts for mounting the adjusting elements.

As disclosed in FIG. 3, all the adjusting elements 8 of a first row of inlet valves 9 of the cylinders are pressed onto the hollow shaft 6. The adjusting elements 8*a* of a further row of identical inlet valves 9 of all the cylinders are rigidly connected to the further shaft 7. For this purpose, the further shaft 9 comprises a segment-shaped slot 18 in the region of the adjusting elements 8*a*. An entraining element 19 configured in the present embodiment as a pin projects through this slot 18. The entraining element 19 is fixed both in a reception 20 of the further shaft 7 and in a reception 21 of the adjusting element 8*a*. These measures permit the two inlet valves 9 of each cylinder to be displaced independently of each other. Thus, for example, at low speeds of rotation and loads one inlet valve 9 can be completely shut off or execute only a minimum lift. The other inlet valve 9 then remains open in a "normal" manner so that a strong turbulence that promotes mixture build-up is produced in the cylinder.

It goes without saying that it is also conceivable to use the measures proposed by the invention for influencing even three inlet valves per cylinder independently of one another. In this case, the further shaft 7 would have to receive still another shaft in its interior and be provided with additional entraining elements that would project through the further shaft 7 as well as the hollow shaft 6.

Seen as a whole, therefore, a valve train is created that not only includes the advantages of known variable mechanical systems but also possesses an enhanced variability that further approaches the variability of electromagnetic valve trains.

List of reference numerals

| | |
|---|---|
| 1 | Valve train |
| 2 | Cam |
| 3 | Camshaft |
| 4 | First working surface |
| 5 | Transmission element |
| 5a | Lever |
| 5b | Ratchet |
| 6 | Hollow shaft |
| 7 | Further shaft |
| 8 | Adjusting element (pivoting finger) |
| 8a | Adjusting element (pivoting finger) |
| 9 | Inlet valve |
| 9a | Scanning contour |
| 10 | End |
| 11 | Fulcrum |
| 12 | Third working surface |
| 13 | Second working surface |

-continued

| List of reference numerals | |
|---|---|
| 14 | Contact surface |
| 15 | Direct valve actuating element (finger lever) |
| 16 | Support element |
| 17 | Bore |
| 18 | Slot |
| 19 | Entraining element |
| 20 | Reception |
| 21 | Reception |

What is claimed is:

1. A variable valve train (1) for load control of a spark-ignited internal combustion engine, preferably a fully variable valve train (1) for throttle-free load control of the internal combustion engine, said valve train (1) being arranged between cams (2) of a camshaft (3) and inlet valves (9) of cylinders of the internal combustion engine and comprising direct valve actuating elements (15), transmission elements (5) and adjusting elements (8, 8*a*) for influencing the lifting function of the transmission elements (5) that are drivingly installed between the cams (2) and the valve actuating elements (15) and have first working surfaces (4) loaded by the cams (2) and second working surfaces (13) acting on the valve actuating elements (15), characterized in that each cylinder possesses at least two inlet valves (9), and at least one particular part of the transmission element (5) comprising the second working surface (13) and one particular adjusting element (8, 8*a*) are associated to each inlet valve (9), said particular adjusting element (8, 8*a*) being displaceable relative to a further adjusting element (8, 8*a*) of a second inlet valve (9) or to further adjusting elements of further inlet valves of each cylinder, the adjusting elements (8) are pivoting fingers or eccentrics and are mounted on a hollow shaft (6) that extends in direction of the inlet valves (9), the adjusting elements (8) of a first row of identical inlet valves (9) of all cylinders are fixed to the hollow shaft (6) by a rigid connection, and when two inlet valves (9) are provided for each cylinder, the adjusting elements (8*a*) of a further row of adjacent identical inlet valves (9) of all cylinders are rotatably mounted relative to the hollow shaft (6), a further shaft (7) is arranged in a bore (17) of the hollow shaft (6) for relative rotation thereto, which further shaft (7) comprises an entraining element (19) for each adjusting element (8*a*) of the further row of identical inner valves (9), and said entraining element (19) projects through the hollow shaft (6) and is connected to the associated adjusting elements (8*a*).

2. A valve train according to claim 1, characterized in that, the hollow shaft (6) comprises in the region of each projecting entraining element (19), a segment-shaped slot (18), the entraining element (19) is configured as a pin or similar to a pin or as a screw and extends on one side in a reception (20) of the further shaft (7) and on another side in a reception (21) of the associated adjusting element (8*a*).

3. A valve train according to claim 2, characterized in that the slot (18) describes an are that defines a desired maximum angular displacement of the adjusting elements (8) for the first row of inlet valves (9) relative to the adjusting elements (8*a*) for the further row of inlet valves (9).

4. A valve train according to claim 1, characterized in that the rigid connection of the adjusting elements (8) to the hollow shaft (6) is effected by an interference fit.

5. A valve train according to claim 1, characterized in that each of the hollow shaft (6) and the farther shaft (7) has a separate electric or hydraulic actuator.

6. A valve train according to claim 5, characterized in that the actuators are arranged on opposite ends of the shafts (6, 7).

7. A valve train according to claim 1 wherein the valve actuating elements (15) are finger levers.

8. A variable valve train (1) for load control of a spark-ignited internal combustion engine, preferably a fully variable valve train (1) for throttle-free load control of the internal combustion engine, said valve train (1) being arranged between cams (2) of a camshaft (3) and inlet valves (9) of cylinders of the internal combustion engine and comprising direct valve actuating elements (15), transmission elements (5) and adjusting elements (8, 8*a*) for influencing the lifting function of the transmission elements (5) that are drivingly installed between the cams (2) and the valve actuating elements (15) and have first working surfaces (4) loaded by the cams (2) and second working surfaces (13) acting on the valve actuating elements (15), characterized in that each cylinder possesses at least two inlet valves (9), and at least one particular part of the transmission element (5) comprising the second working surface (13) and one particular adjusting element (8, 8*a*) are associated to each inlet valve (9), said particular adjusting element (8, 8*a*) being displaceable relative to a further adjusting element (8, 8*a*) of a second inlet valve (9) or to further adjusting elements of further inlet valves of each cylinder the adjusting elements (8) are pivoting fingers or eccentrics and are mounted on a hollow shaft (6) that extends in direction of the inlet valves (9), the adjusting elements (8) of a first row of identical inlet valves (9) of all cylinders are fixed to the hollow shaft (6) by a rigid connection, and when two inlet valves (9) are provided for each cylinder, the adjusting elements (8*a*) of a further row of adjacent identical inlet valves (9) of all cylinders are rotatably mounted relative to the hollow shaft (6), a further shaft (7) is arranged in a bore (17) of the hollow shaft (6) for relative rotation thereto, which further shaft (7) comprises an entraining element (19) for each adjusting element (8*a*) of the further row of identical inner valves (9), and said entraining element (19) projects through the hollow shaft (6) and is connected to the associated adjusting elements (8*a*), the transmission elements (5) have a two-part configuration comprising a lever (5*a*) having the first working surface (4) and at least one ratchet (5*b*) having the second working surface (13), which ratchet (5*b*) is fixed with its fulcrum (11) on an end (10) of the lever (5*a*) oriented toward the valve actuating elements (15), and the second working surface (13) adjoins a contact surface (14) of the valve actuating element (15), each ratchet (5*b*) comprises a third working surface (12) for the respective adjusting element (8, 8*a*) configured as a pivoting finger, said third working surface (12) extends on a side oriented away from the second working surface (13) and scans a scanning contour (9*a*) of the adjusting element (8) during cam lift, whose lobe extends in opening direction of the inlet valve (9), the scanning contour (9*a*) being displaceable relative to the third working surface.

* * * * *